US008422915B2

(12) United States Patent
Choi et al.

(10) Patent No.: US 8,422,915 B2
(45) Date of Patent: Apr. 16, 2013

(54) DEVELOPER CARTRIDGE, DEVELOPING DEVICE, AND IMAGE FORMING APPARATUS HAVING THE SAME

(75) Inventors: Sam-Seok Choi, Suwon-si (KR); Seung-Gweon Lee, Suwon-si (KR); Jong-Moon Eun, Yongin-si (KR); Jean-Man Sur, Suwon-si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 836 days.

(21) Appl. No.: 12/240,716

(22) Filed: Sep. 29, 2008

(65) Prior Publication Data

US 2009/0214269 A1 Aug. 27, 2009

(30) Foreign Application Priority Data

Feb. 22, 2008 (KR) ..... 10-2008-0016469

(51) Int. Cl.
*G03G 15/08* (2006.01)

(52) U.S. Cl.
USPC ..... 399/120

(58) Field of Classification Search ..... 399/110, 399/111, 120, 258, 263
See application file for complete search history.

(56) References Cited

U.S. PATENT DOCUMENTS

| | | | | |
|---|---|---|---|---|
| 4,967,234 | A | 10/1990 | Tani et al. | |
| 4,974,020 | A | 11/1990 | Takamatsu et al. | |
| 4,977,429 | A | 12/1990 | Tani et al. | |
| 5,479,247 | A | 12/1995 | Watanabe et al. | |
| 5,493,366 | A | 2/1996 | Satoh et al. | |
| 5,499,077 | A | 3/1996 | Endo et al. | |
| 5,589,915 | A | 12/1996 | Hashimoto | |
| 5,649,264 | A | 7/1997 | Domon et al. | |
| 5,734,953 | A | 3/1998 | Tatsumi | |
| 5,848,342 | A | 12/1998 | Tanda | |
| 5,960,238 | A | 9/1999 | Ohgami | |
| 6,041,212 | A * | 3/2000 | Okada | 399/359 |
| 6,104,888 | A | 8/2000 | Kobayashi | |
| 6,151,459 | A | 11/2000 | Hashimoto et al. | |

(Continued)

FOREIGN PATENT DOCUMENTS

| | | | |
|---|---|---|---|
| CN | 1298126 | A | 6/2001 |
| EP | 0 570 993 | A1 | 11/1993 |

(Continued)

OTHER PUBLICATIONS

Machine translation of JP 2006-309016.*

(Continued)

*Primary Examiner* — Walter L Lindsay, Jr.
*Assistant Examiner* — Barnabas Fekete
(74) *Attorney, Agent, or Firm* — Stanzione & Kim, LLP

(57) ABSTRACT

A developing cartridge and a developing device capable of preventing developer leak which may occur during replacement of a developer containing unit, and an image forming apparatus having the same are provided. The image forming apparatus includes an image forming apparatus body where a transfer path for a printing medium is formed, and a developing device for developing a visible image. The developing device may include, for example, developing cartridge, a developer containing unit, which contains a supply of developer therein, and which is detachably disposed in the developing cartridge to form a developer transfer path fluidly communicating with the developing cartridge, and a shutter unit which closes the developer transfer path when the developer containing unit is removed from the developing cartridge.

45 Claims, 12 Drawing Sheets

U.S. PATENT DOCUMENTS

| | | | | |
|---|---|---|---|---|
| 6,792,230 | B2 | 9/2004 | Saito et al. | |
| 6,980,758 | B2 | 12/2005 | Murayama et al. | |
| 7,340,197 | B2 | 3/2008 | Murayama et al. | |
| 2002/0085857 | A1 | 7/2002 | Kim et al. | |
| 2002/0085887 | A1 | 7/2002 | Schneider et al. | |
| 2002/0141788 | A1* | 10/2002 | Matsuda et al. | 399/260 |
| 2003/0161653 | A1 | 8/2003 | Ban et al. | |
| 2004/0001723 | A1 | 1/2004 | Ashida et al. | |
| 2004/0223772 | A1 | 11/2004 | Nakazato | |
| 2005/0047821 | A1 | 3/2005 | Murayama et al. | |
| 2005/0095020 | A1 | 5/2005 | Eom et al. | |
| 2005/0254860 | A1 | 11/2005 | Kimura et al. | |
| 2005/0260011 | A1 | 11/2005 | Murayama et al. | |
| 2006/0210285 | A1 | 9/2006 | Nakazato | |
| 2006/0285880 | A1 | 12/2006 | Okabe | |
| 2007/0071503 | A1* | 3/2007 | Sato | 399/258 |
| 2007/0230999 | A1 | 10/2007 | Shimomura | |
| 2008/0056772 | A1 | 3/2008 | Utsumi et al. | |

FOREIGN PATENT DOCUMENTS

| | | |
|---|---|---|
| EP | 0 672 971 | 9/1995 |
| EP | 1 103 865 | 5/2001 |
| EP | 1 437 632 | 7/2004 |
| EP | 1 840 671 | 10/2007 |
| EP | 1840671 | 10/2007 |
| EP | 1 881 378 | 1/2008 |
| EP | 1881378 | 1/2008 |
| JP | 60-238873 | 11/1985 |
| JP | 01-091164 | 4/1989 |
| JP | 09-022177 | 1/1997 |
| JP | 10-142910 | 5/1998 |
| JP | 11-24513 | 1/1999 |
| JP | 2000-75627 | 3/2000 |
| JP | 2000-075659 | 3/2000 |
| JP | 2004-264539 | 9/2004 |
| JP | 2005-326637 | 11/2005 |
| JP | 2005-338329 | 12/2005 |
| JP | 2006-091284 | 4/2006 |
| JP | 2006-309016 | 11/2006 |
| JP | 2007-025511 | 2/2007 |
| KR | 91-1489 | 1/1991 |
| KR | 10-2001-0061976 | 7/2001 |
| KR | 10-2005-0033796 | 4/2005 |
| KR | 10-2006-0034168 | 4/2006 |
| KR | 10-2006-0128338 | 12/2006 |
| RU | 2266553 | 4/2005 |

OTHER PUBLICATIONS

CN Office Action issued Mar. 24, 2011 in CN Application No. 200810174015.4.
European Search Report issued in EP 09150067.8, mailed Jun. 3, 2009.
English language abstract of JP 60-238873, published Nov. 27, 1985.
English language abstract of JP 01-091164, published Apr. 10, 1989.
Office Action issued in KR 10-32008-0016469, mailed Jun. 3, 2009.
English language abstract of JP 2005-326637, mailed Nov. 24, 2005.
Machine English language translation of JP 2005-326637, mailed Nov. 24, 2005.
Machine English language translation of JP 2005-338329, published Dec. 8, 2005.
Machine English language translation of JP 10-142910, published May 29, 1998.
Machine English language translation of JP 11-24513, published Jan. 29, 1999.
Machine English language translation of JP 2000-75627, published Mar. 14, 2000.
Office Action issued in Russian patent application No. 2008148636, mailed Oct. 28, 2009.
English language translation of Office Action issued in Russian patent application No. 2008148636, mailed Oct. 28, 2009.
English language abstract of JP 2000-075659, published Mar. 14, 2000.
Machine English language translation of JP 2000-075659, published Mar. 14, 2000.
English language abstract of RU 2289835, published Dec. 20, 2006.
English language abstract of JP 2005-338329, published Dec. 8, 2005.
European Search Report issued in EP 09 15 0144, issued Jan. 22, 2010.
English language abstract of JP 2004-264539, published Sep. 24, 2004.
Machine English language translation of JP 2004-264539, published Sep. 24, 2004.
Office Action issued in Russian patent application No. 2008148667, mailed Dec. 11, 2009.
English language translation of Office Action issued in Russian patent application No. 2008148667, mailed Dec. 11, 2009.
Notice of Allowance issued in Russian Application No. 2008148634, mailed Jan. 21, 2010.
Partial English language translation of Notice of Allowance issued in Russian Application No. 2008148634, mailed Jan. 21, 2010.
English language abstract of RU 2,266,553, published Apr. 20, 2005.
English language abstract of JP 2007-025511, published Feb. 1, 2007.
Machine English language translation of JP 2007-025511, published Feb. 1, 2007.
Korean Office Action issued in Application No. 10-2008-0016455, issued Jan. 23, 2009.
English abstract of KR 10-2006-0128338, published Dec. 14, 2006.
English Language abstract of KR 91-1489, published Jan. 31, 1991.
Korean Office Action issued in Application No. 10-2008-0016464, mailed Feb. 6, 2009.
Korean Office Action issued in Application No. 10-2008-0016467, mailed Jan. 30, 2009.
English language abstract of KR 10-2006-0034168, published Apr. 21, 2006.
English language abstract of JP 09-022177, published Jan. 21, 1997.
Machine English language translation of JP 09-022177, published Jan. 21, 1997.
Korean Office Action issued in Application No. 10-2008-0016472, mailed Feb. 5, 2009.
English language abstract of KR 10-2005-0033796, published Apr. 13, 2005.
Korean Office Action issued in Application No. 10-2008-0016469, mailed Feb. 6, 2009.
English language abstract of KR 10-2001-0061976, published Jul. 7, 2001.
Russian Office Action dated May 4, 2010 issued in RU Application No. 2008148633.
European Search Report issued in European Application No. 09 15 0141, mailed Apr. 14, 2009.
European Search Report Issued in European Application No. 09 15 0066, mailed Jul. 29, 2009.
European Search Report Issued in European Application No. 09 15 2590, mailed Aug. 17, 2009.
Chinese Office Action issued Apr. 5, 2012 in CN Application No. 200810174015.4.
European Search Report issued Apr. 10, 2012 in EP Application No. 09152577.4.
European Examination Report issued Apr. 23, 2012 in EP Application No. 09 152 557.4.
Russian Notice of Allowance issued Jul. 22, 2010 in RU Application No. 2008148622.

* cited by examiner

DEVELOPER CARTRIDGE, DEVELOPING DEVICE, AND IMAGE FORMING APPARATUS HAVING THE SAME

CROSS-REFERENCE TO RELATED APPLICATIONS

This application claims priority under 35 U.S.C. § 119 (a) from Korean Patent Application No. 10-2008-0016469, filed on Feb. 22, 2008, in the Korean Intellectual Property Office, the disclosure of which is incorporated herein by reference in its entirety.

BACKGROUND OF THE INVENTION

1. Field of the Invention

The present invention relates to an image forming apparatus, and more particularly, to a developing device in an image forming apparatus having the same.

2. Description of the Related Art

An forming apparatus, such as, for example, a printer, a photocopier, a facsimile machine, a multifunction peripheral, or the like, performs printing of images using developer. After repeated printing operations, the developer may be used up, and thus may need to be replenished.

To replenish, a developing cartridge containing storing the developer therein may need to be replaced. However, the developing cartridge may also include other components, such as, e.g., a developing roller and/or a supply roller, which may have relatively longer useful life. Replacement of the developing cartridge for the purpose of developer replenishment may thus be uneconomical.

The present applicants have contemporaneously herewith suggested a separable type developing cartridge with a removable developer cartridge that allows the developer to be replenished with replacement of only the removable developer cartridge. However, while the removable developer cartridge may alleviate the need for unnecessary replacement of the entire developing cartridge, the replacement of the removable developer cartridge may become messy as remaining developer often leaks out of the opening through which the developer is supplied outside the removable cartridge, and may result in contaminating other components of the image forming apparatus.

BRIEF DESCRIPTION OF THE DRAWINGS

Various features and advantages of the disclosure will become more apparent by the following detailed description of several embodiments thereof with reference to the attached drawings, of which.

DETAILED DESCRIPTION OF SEVERAL EMBODIMENTS

Figure 1:
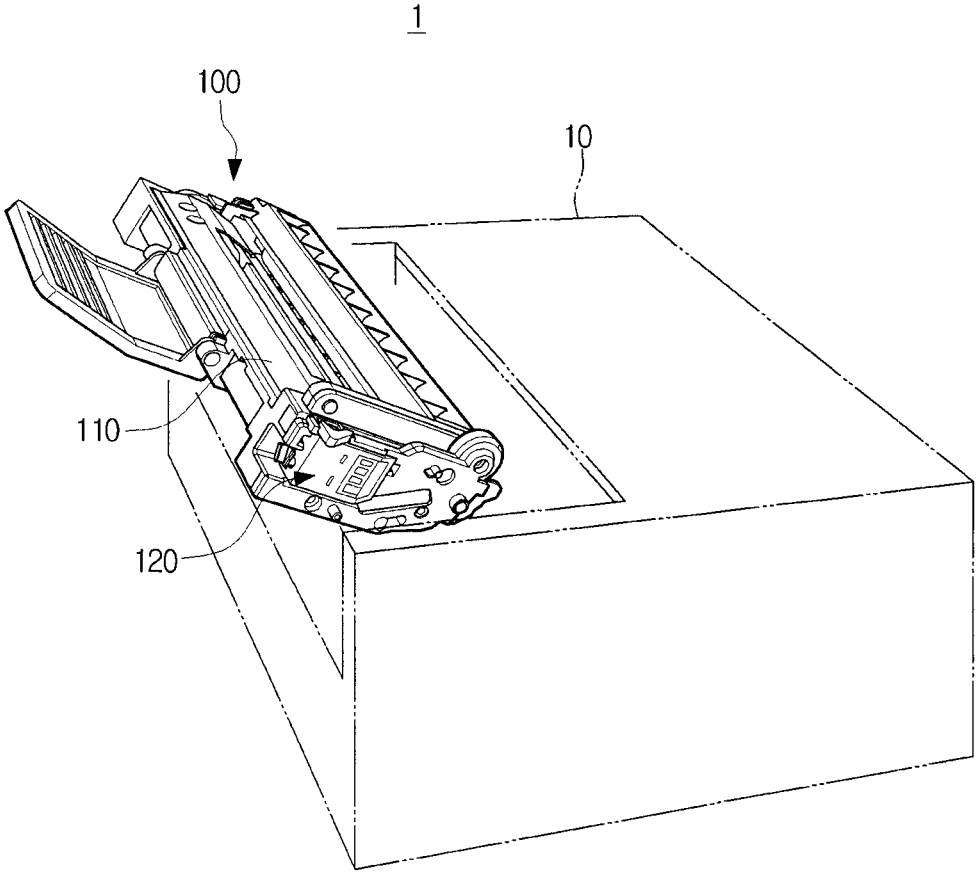
FIG. 1 is a perspective view schematically illustrating an image forming apparatus according to an embodiment of the present invention.

Reference will now be made in detail to the embodiments of the present invention, examples of which are illustrated in the accompanying drawings, wherein like reference numerals refer to the like units throughout. The matters described herein, such as a detailed construction and elements thereof, are provided to assist in a comprehensive understanding of the embodiments, may not be all required to practice the various aspects of the present invention. Thus, it should be readily apparent that aspects of the present invention may be carried out without those details described herein. For the sake of brevity, and in order to avoid obscuring the description with unnecessary detail, well-known functions or constructions will not be described in detail.

Referring to FIG. 1, an image forming apparatus 1 according to an embodiment of the present invention may include an image forming apparatus body 10 and a developing device 100.

The image forming apparatus body 10 has a transfer path formed therein to transfer a printing medium using transferring means such as rollers and has various of parts housed therein for forming an image on the transferred printing medium.

Figure 2:
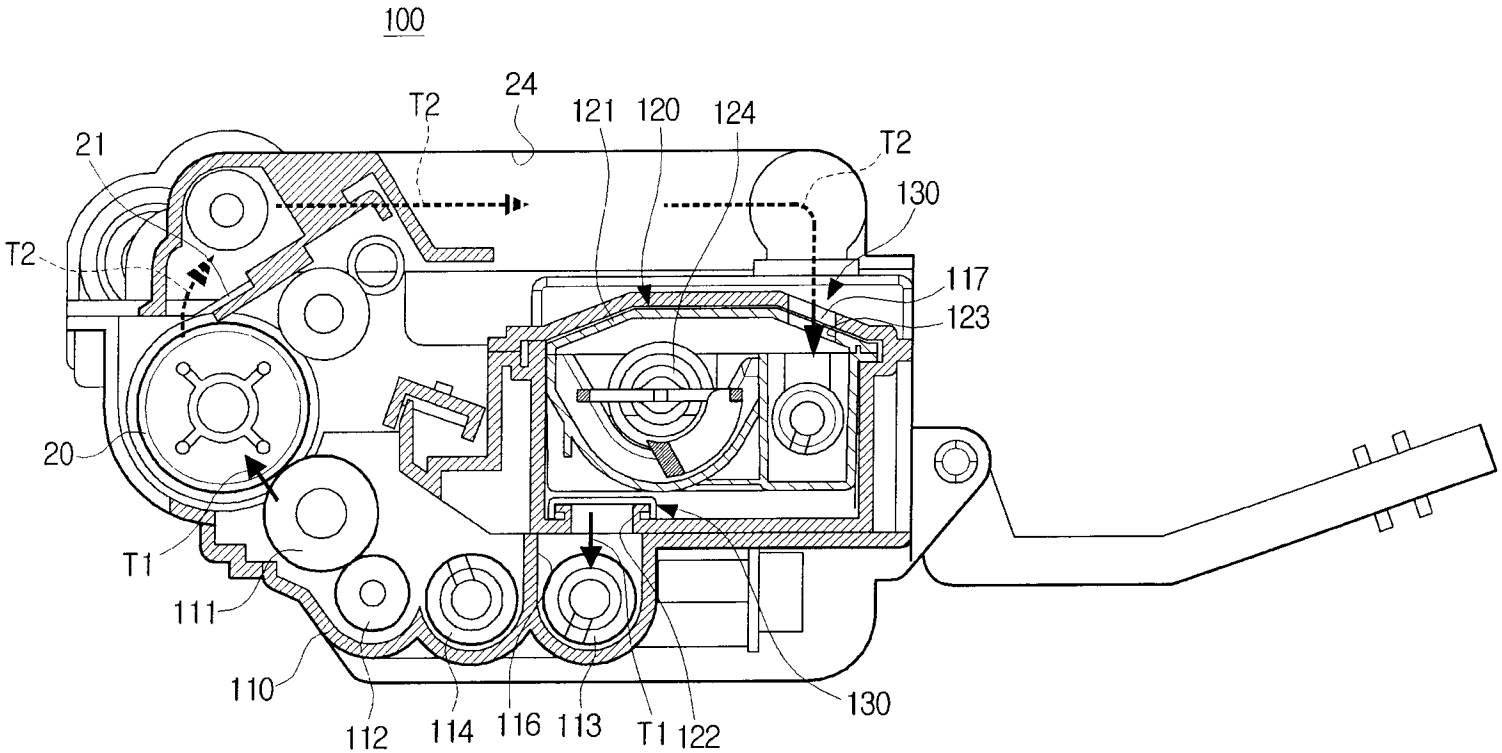
FIG. 2 is a cross-section view schematically illustrating a developing device of FIG. 1.

Various parts of the image forming apparatus 1 for forming an image are well known, and thus detailed descriptions thereof are unnecessary. As shown in FIG. 1, the developing device 100 enters the image forming apparatus body 10 in the direction R2 (See FIG. 4), and may be mounted in the image forming apparatus body 10. The developing device 100 may include a developing cartridge 110, a developer containing unit 120, and shutter units 130 as shown in FIG. 2.

The developing cartridge 110 may be employed to develop an electrostatic latent image formed on a photoconductive medium 20 with developer, and may include a developing roller 111 to develop the electrostatic latent image of the photoconductive medium 20 and a supply roller 112 to supply developer to the developing roller 111. Also, the developing cartridge 110 may further include first and second agitating rollers 113 and 114 to agitate the developer in the developing cartridge 110 and to uniformly transfer the developer to the supply roller 112.

As an example, in this embodiment, the photoconductive medium 20 may be mounted in the developing cartridge 110, and also, a cleaning blade 21 for cleaning a remaining developer off the photoconductive medium 20 may be supported in the developing cartridge 110. Alternatively, however, the photoconductive medium 20 and/or the cleaning blade 21 may be disposed in the image forming apparatus separately from the developing device 100.

Figure 4:
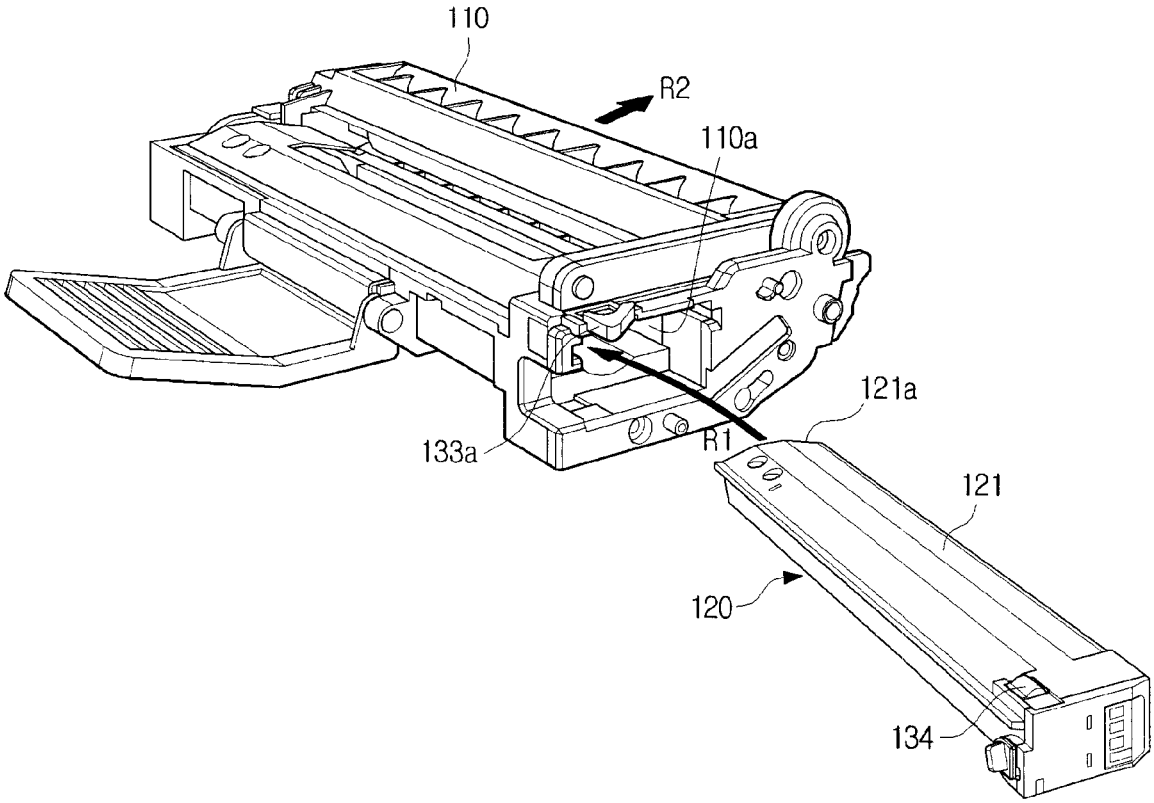
FIG. 4 is a perspective view schematically illustrating a developer cartridge to be mounted in a developing cartridge according to an embodiment of the invention.

The developer containing unit 120 may contain a quantity of developer therein, and, as shown in FIG. 4, is removably mounted in the developing cartridge 110. For this, the developing cartridge 110 has a mounting recess 110*a* (see FIG. 4) for accommodating the developer containing unit 120.

According to an embodiment, the mounting recess 110*a* may be formed to extend along the length of, and from one end to the other end of, the developing cartridge 110, penetrating through the developing cartridge 110, and may have a predetermined depth. and a predetermined length parallel to the direction R1 perpendicular to the mounting direction R2 (see FIG. 4) of the developing cartridge 110. Accordingly, the developer containing unit 120 enters the developing cartridge 110 in the direction of R1 perpendicular to the mounting direction R2 of the developing cartridge 110.

Referring to FIG. 2, if the developer containing unit 120 is mounted in the developing cartridge 110, the developer containing unit 120 forms a developer transfer paths T1 and T2 in association with the developing cartridge 110. In this embodiment, as shown in FIG. 2, the developer containing unit 120 is a developer cartridge 121 that supplies the developer to the developing cartridge 110, and may also collect waste developer discharged from the developing cartridge 110.

The developer transfer paths T1 and T2 formed between the developer cartridge 121 and the developing cartridge 110 are, respectively, a supply path T1, through which the developer is supplied from the developer cartridge 121 to the developing cartridge 110, and a collecting path T2, through which waste developer discharged from the developing cartridge 110 is collected in the developer cartridge 121.

The supply path T1 includes first and second transfer openings 122 and 116, which are formed in the developer cartridge 121 and in the developing cartridge 110, respectively, such that they face each other, and fluidly communicate with each other if the developer cartridge 121 is mounted in the developing cartridge 110.

The first transfer opening 122 serves as an outlet through which the developer is discharged from the developer cartridge 121, and the second transfer opening 116 serves as an inlet through which the developer flows into the developing cartridge 110.

The developer cartridge 121 may have a developer transfer member 124 rotatably formed therein to transfer the developer from the developer cartridge 121 to the supply path T1 through the first transfer opening 122.

The collecting path T2 may include third and fourth transfer openings 117 and 123, which are formed in the developing cartridge 110 and in the developer cartridge 121, respectively, such that they face, and fluidly communicate with, each other if the developer cartridge 121 is mounted in the developing cartridge 110.

The third transfer opening 117 serves as the waste developer outlet, through which the waste developer is discharged from the developing cartridge 110, and the fourth transfer opening 123 serves as the waste developer inlet, through which the waste developer flows into the developer cartridge 121.

Figure 3:
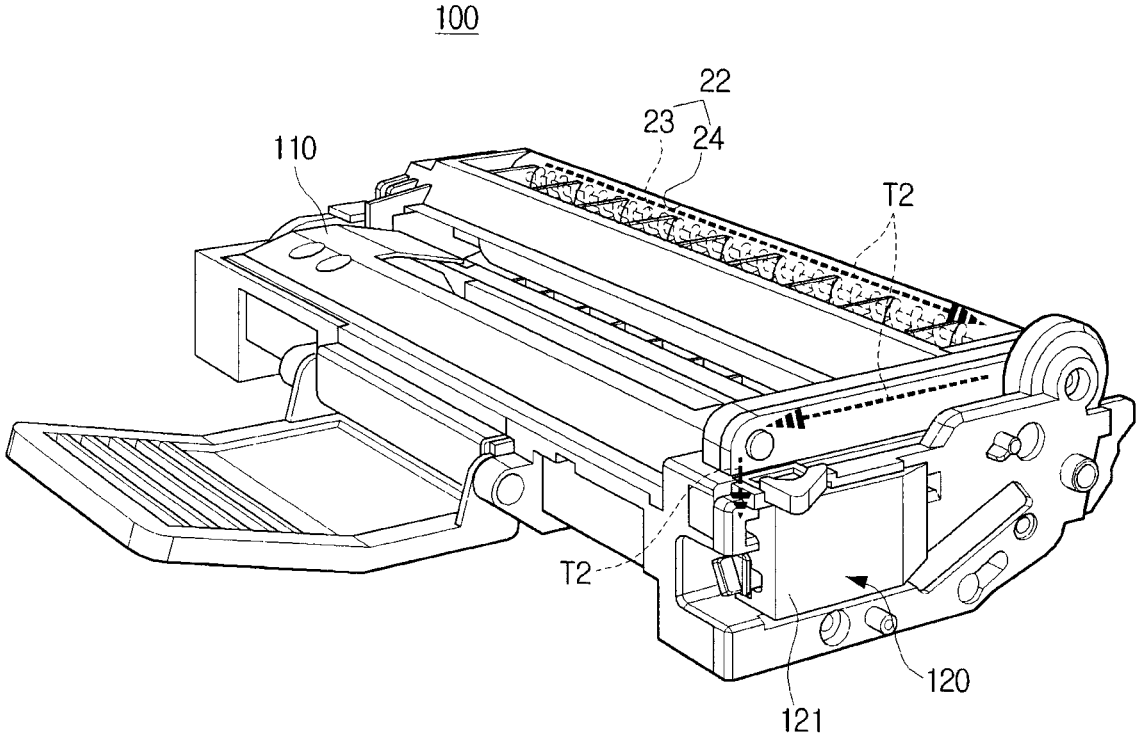
FIG. 3 is a perspective view schematically illustrating a collecting path formed in a developing device according to an embodiment of the invention.

The waste developer is developer that has been cleaned off the photoconductive medium 20 by the cleaning blade 21, and, as shown in FIGS. 2 and 3, is transferred to the collecting path T2 by waste developer transferring mechanism 22. The waste developer transferring mechanism 22 may include a waste developer transfer member 23 and a waste developer transfer pipe 24.

According to an embodiment, the supply path T1 and the collecting path T2 are formed in the proximity of the entering or leading end and an exiting or trailing end of the developer cartridge 121, respectively, with reference to the mounting direction of the developer cartridge 121.

The shutter units 130 opens the developer transfer paths T1 and T2 only if the developer cartridge 121 is mounted in the developing cartridge 110. That is, the shutter units 130 opens both the supply path T1 and the collecting path T2 if the developer cartridge 121 is mounted in the developing cartridge 110, and conversely, closes both of them if the developer cartridge 121 is removed from the developing cartridge 110.

As shown in FIGS. 5A through 10, the shutter unit 130 includes first through fourth shutter members 131, 132, 133, 134 corresponding to the first through fourth transfer openings 122, 116, 117, 123.

Figure 8A:
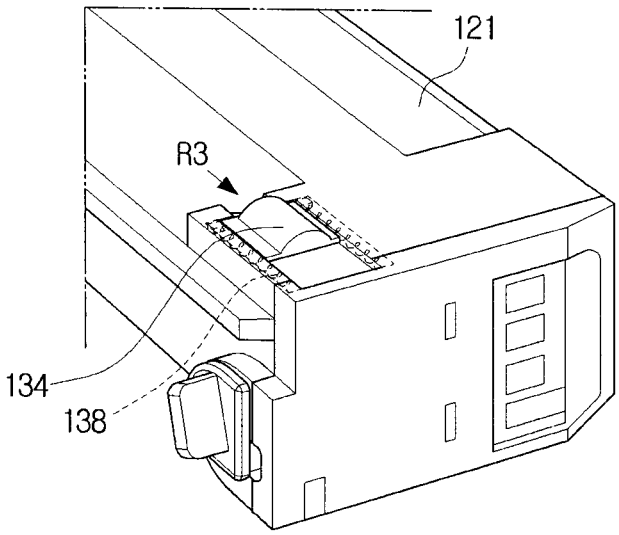
FIGS. 8A and 8B are perspective views illustrating operations of a fourth shutter member according to an embodiment of the invention.

More specifically, as shown in FIGS. 5A through 6C, the first and the second shutter members 131, 132 are disposed in the developer cartridge 121 and the developing cartridge 110, respectively, to open and close the first and the second transfer openings 122 and 116, respectively. As shown in FIGS. 8A through 9, the third and the fourth shutter members 133 and 134 are disposed in the developing cartridge 110 and the developer cartridge 121, respectively, to open and close the third and the fourth transfer openings 117 and 123, respectively.

The first, the second, and the fourth shutter members 131, 132, 134 open the first, the second, and the fourth transfer openings 122, 116, 123 if the developer cartridge 121 is mounted in the mounting recess 110*a* of the developing cartridge 110 in the first direction R1. Also, the third shutter member 133 opens the third transfer opening 116 if the developing cartridge 110 is mounted in the image forming apparatus body 10 in the second direction R2.

The first through fourth shutter members 131, 132, 133, 134 described above are elastically supported by first through fourth elastic members 135, 136, 137, 138, respectively, in directions of closing the first through the fourth transfer openings 122, 116, 117, 123.

As shown in FIGS. 5A through 6C, when the developer cartridge 121 is mounted in the developing cartridge 110, the first shutter member 131 is prevented from moving further in the direction R1 by the locking projection 131*b* formed in the proximity of the second transfer opening 116 of the developing cartridge 110, thereby opening the first transfer opening 122. That is, although the developer cartridge 121 moves in the first direction R1, the first shutter member 131 is interfered by the locking projection 131*b*, and does not move in the first direction R1 such that the first transfer opening 122 of the developer cartridge 121 is opened.

The end of the first shutter member 131, which is brought into contact with the locking projection 131*b*, is bent toward the developing cartridge 110 while the other end is supported by the first elastic member 135.

On the locking projection 131*b* is disposed a guide lever 140 which is rotated by the interference from the developer cartridge 121, and which assists the first shutter member 131 in opening and closing the first transfer opening 122. The guide lever 140 includes first and second wings 141 and 142 rotating about a rotary shaft 140*a* and a pressure protrusion 143.

Figure 5A:
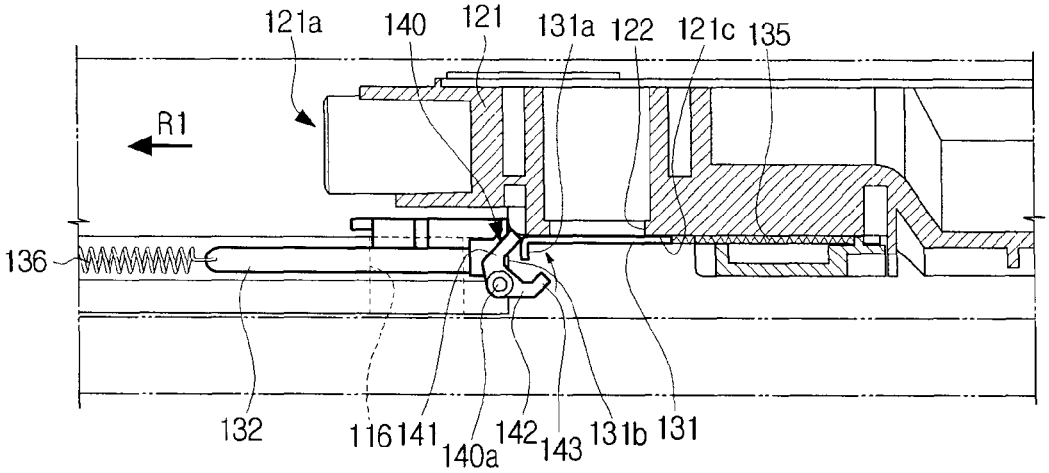
FIG. 5A through 5C are views illustrating opening operations of a first shutter member and a second shutter member according to an embodiment of the invention.
Figure 5B:
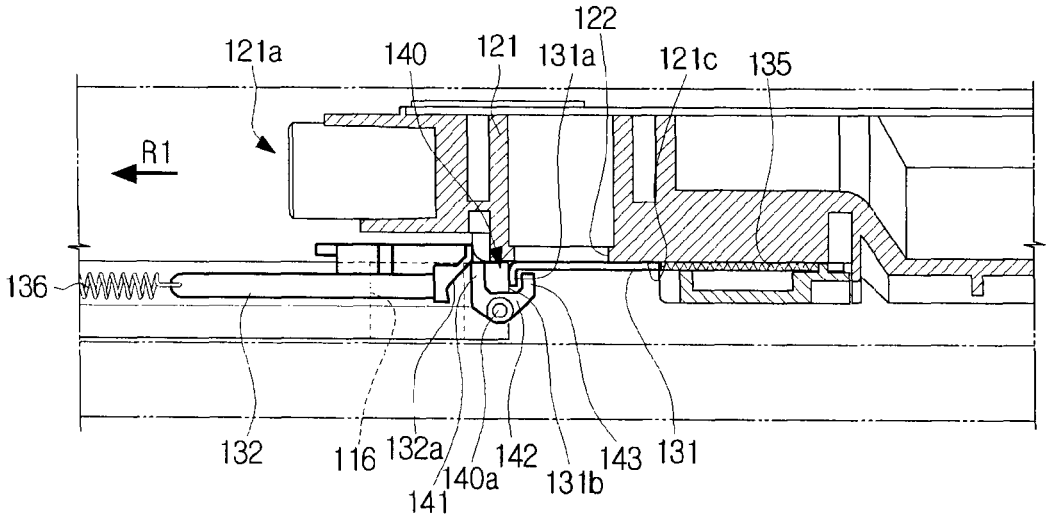
Figure 5C:
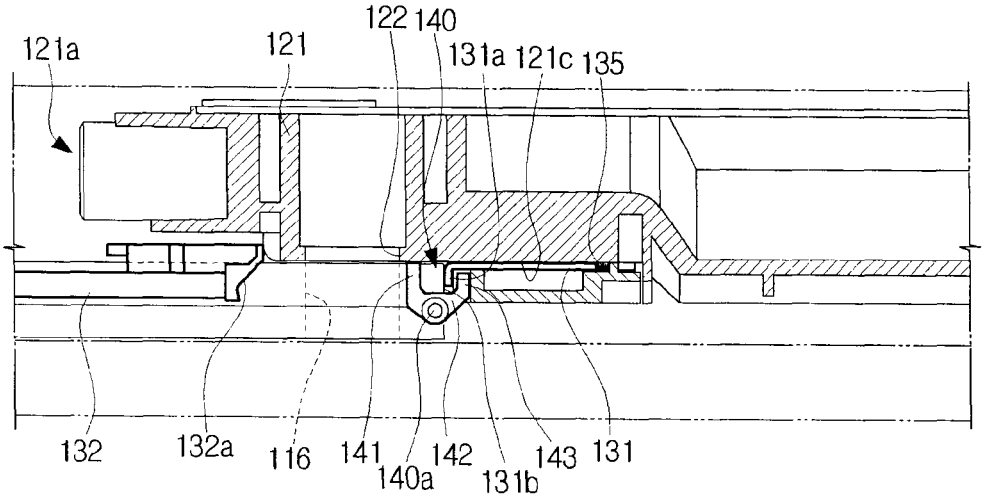

The first wing 141 is rotated by the bent end of the first shutter member 131 in the first direction R1, and, as shown in FIG. 5C, has a length such that the first wing 141 is brought into contact with the bottom 121*c* of the developer cartridge 121 facing the developing cartridge 110.

The second wing 142 may have a shorter length than that of the first wing 141, and may be spaced from the first wing 141 at a predetermined angle. Therefore, the second wing 142 is not brought into contact with the bottom 121*c* of the developer cartridge 121 when rotated to the position shown in FIG. 5C.

The pressure protrusion 143 protrudes from the second wing 142 and presses the one end of the first shutter member 131 in the first direction R1 if the first wing 141 is brought into contact with the bottom of the developer cartridge 121.

As shown in FIGS. 5A through 5C, the second shutter member 132 is interfered by a leading end 121*a* of the developer cartridge 121 with reference to the first direction R1, and thus moves in the first direction R1, thereby opening the second transfer opening 116.

If the developer cartridge 121 is mounted in the mounting recess 110*a* of the developing cartridge 110, the leading end 121*a*, which enters the mounting recess 110*a* first with reference to the mounting direction of the developer cartridge 121 i.e. the direction R1, is brought into contact with the second shutter member 132 of the developing cartridge 110, and the other end of the developer cartridge 121 is exposed to the outside through the mounting recess 110*a*, and forms an outer wall together with the developing cartridge 110 as shown in FIG. 3.

The second shutter member 132 has an inclined surface 132*a* to restore the guide lever 140 to the initial position. More specifically, as shown in FIG. 6C, if the leading end 121*a* of the developer cartridge 121 moves in the direction R3 opposite to the mounting direction R1, and thus the first wing 141 is released from the contact with the bottom of the developer cartridge 121, the inclined surface 132*a* of the second shutter member 132, which is free from the contact force with the leading end 121*a* of the developer cartridge 121, is brought into contact with the first wing 141, and thus, the first wing 141 is rotated in the direction R3 opposite to the mounting direction R1, and is restored to the original position by a recovering force of the second shutter member 132. For this, the inclined surface 132*a* of the second shutter member 132 is inclined by a predetermined angle corresponding to the initial position of the first wing 141.

Figure 9:
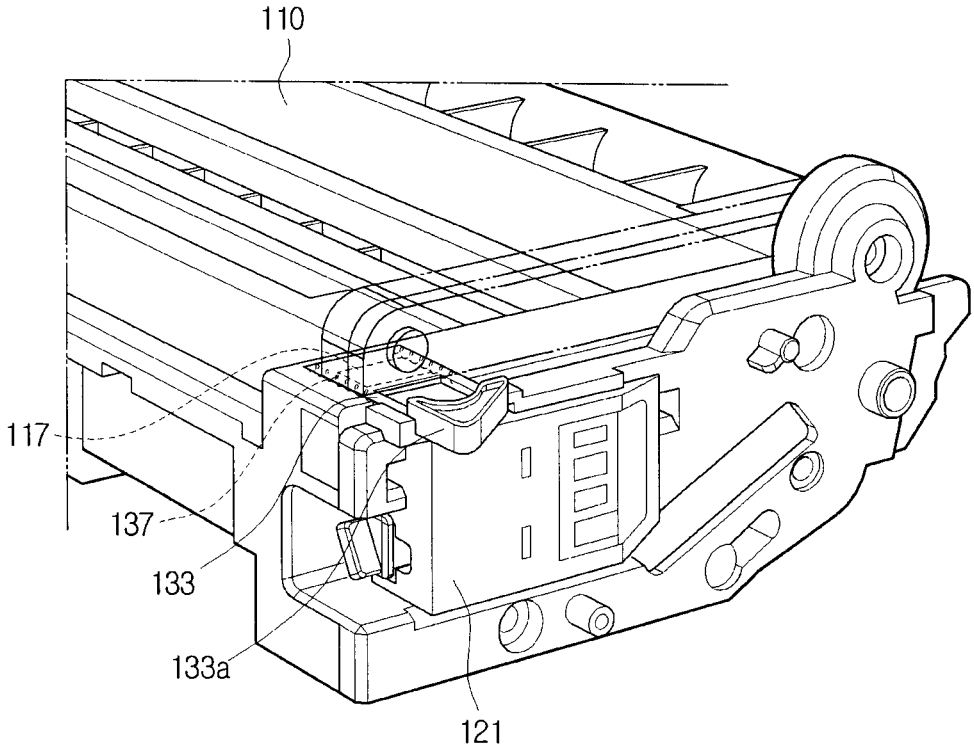
FIGS. 9 and 10 are perspective views illustrating operations of a third shutter member according to an embodiment of the invention.
Figure 10:
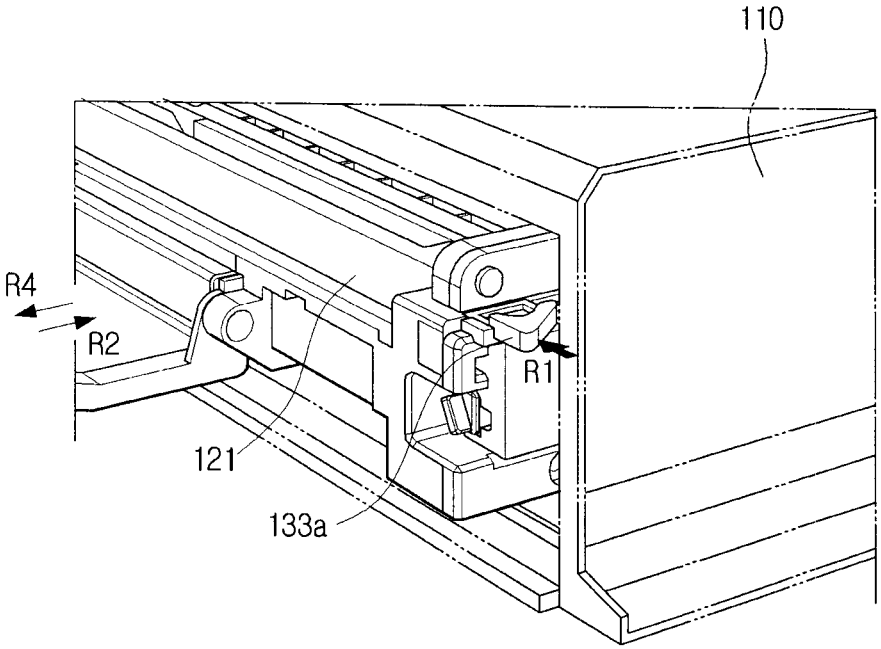

As shown in FIGS. 9 and 10, the third shutter member 133 opens the third transfer opening 116 as an interference member 133*a* protruding from the third shutter member 133 is interfered by the image forming apparatus body 10, and thus moves in the first direction R1. More specifically, if the developing cartridge 110 enters in the second direction R2 and is mounted in the image forming apparatus body 10 with the developer cartridge 121 mounted therein, the interference member 133*a* protruding from the developing cartridge 110 is brought into contact with the image forming apparatus body 10 and thus moves in the direction R1 such that the third shutter member 122 opens the third transfer opening 116.

Figure 7:
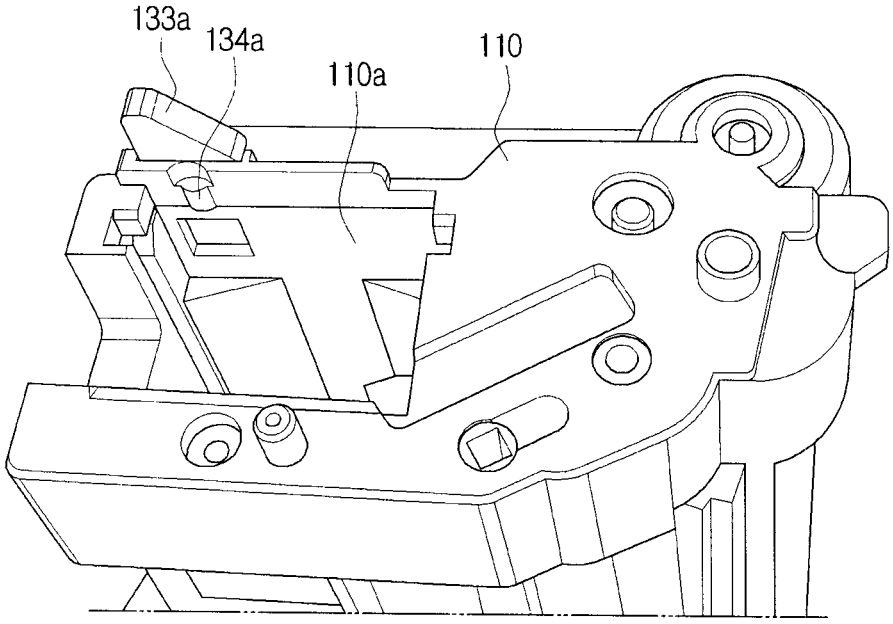
FIG. 7 is a perspective view illustrating a locking protrusion of the developing cartridge according to an embodiment of the invention.

As shown in FIGS. 7 and 8, the fourth shutter member 134 moves in the direction R3 opposite to the mounting direction R1 by means of a locking protrusion 134*a* formed on the developing cartridge 110, thereby opening the fourth opening 123.

Hereinafter, operations of opening and closing the supply path and the collecting path between the developing cartridge and the developer cartridge of the image forming apparatus according to an embodiment of the present invention will be described with reference to FIGS. 2 through 10.

Referring to FIG. 4, if the developer cartridge 121 enters the mounting recess 110*a* of the developing cartridge 110 in the direction R1, as shown in FIGS. 5A through 5C, the bent end 131*a* of the first shutter member 131 is brought into contact with the locking projection 131*b* and thus is prevented from entering further in the first direction R1. At this time, the bent end 131*a* of the first shutter member 131 is also brought into contact with the first wing 141 of the guide lever 140 and thus rotates the first wing 141 in the first direction R1 as shown in FIGS. 5A and 5B.

Although the first shutter member 131 is prevented from moving further in the first direction R1 by the locking projection 131*b*, the developer cartridge 121 continues to enter in the first direction R1 and thus moves the second shutter member 132 which is in contact with the leading end 121*a* of the developer cartridge 121 in the first direction R1.

Consequently, as shown in FIG. 5C, the first and the second transfer openings 122 are 116 are opened by the first and the second shutter members 131 and 132 such that the supply path T1 for transferring the developer from the developer cartridge 121 to the developing cartridge 110 is open.

The first wing 141, which has rotated in contact with one end of the first shutter member 131 in the first direction R1, is in contact with the bottom of the developer cartridge 121 and is prevented from rotating in the first direction R1 as shown in FIG. 5C. Accordingly, the one end of the first shutter member 131 is released from the contact with the first wing 141, and, instead, is brought into contact with the pressure protrusion 143 protruding from the second wing 142 spaced from the first wing 141 by a predetermined angle.

Consequently, the bent end 131*a* of the first shutter member 131 is fixedly at the location between the locking projection 131*b* and the pressure protrusion 143 such that the first shutter member 131 is fixed at the position of opening the first transfer opening 122.

Figure 8B:
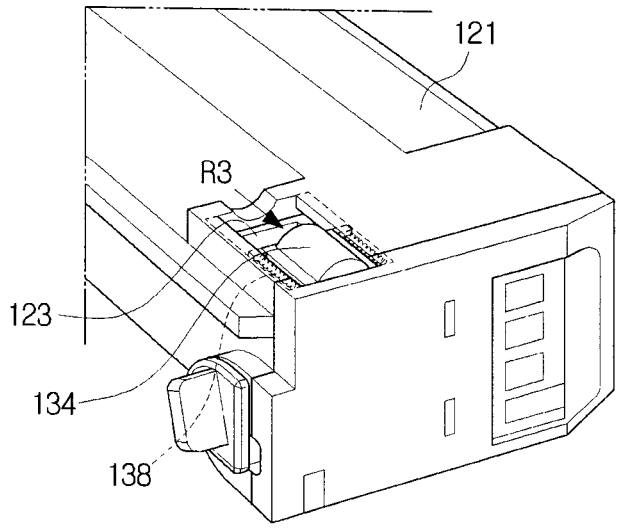

If the developer cartridge 121 further enters the mounting recess 110*a* in the first direction R1, as shown in FIGS. 7 through 8B, the fourth shutter member 134 is brought into contact with the locking protrusion 134*a* formed on the developing cartridge 110, and thus moves in the direction R3 opposite the mounting direction R1, thereby opening the fourth transfer opening 123.

If the developer cartridge 121 is completely mounted in the developing cartridge 110, the first, the second, and the fourth transfer openings 122, 116 and 123 are all open by the first, the second and the fourth shutter members 131, 132 and 134, respectively.

Subsequently, as shown in FIGS. 9 and 10, the developing cartridge 110 enters the image forming apparatus body 10 in the second direction R2 with the developer cartridge 121 mounted therein. At this time, the interference member 133*a* protruding from the third shutter member 133 to protrude from the developing cartridge 110 is brought into contact with the image forming apparatus body 10, thereby moving the third shutter member 133 in the first direction R1. The third transfer opening 116 becomes open by the third shutter member 133 such that the developer supply path T1 and the collecting path T2 between the developer cartridge 121 and the developing cartridge 110 are all open.

According to the above-described configuration, the first and the second shutter members 131 and 132 open the first and the second transfer openings 122 and 116 in sequence in association with the mounting operation of the developer cartridge 121, and then, the fourth transfer opening 123 of the developer cartridge 121 is opened by the fourth shutter member 134. After that, as the developing cartridge 110 is mounted in the image forming apparatus body 10, the third transfer opening 117 is opened by the third shutter member 133 such that the developer collecting path T2 is finally opened. That is, the shutter units 130 opens the developer supply path T1 first, and then opens the developer collecting path T2.

If the developer in the developer cartridge 121 is exhausted, and needed to be replaced, as shown in FIG. 10, the developing cartridge 110 is dismounted from the image forming apparatus body 10 in a direction R4 opposite to the second direction R2, at which time, the interference member 133*a* is released from the interference force from the image forming apparatus body 10 such that the interference member 133*a* is restored to an initial position by an elastic force of the third elastic member 137. Accordingly, the third shutter member 133 closes the third transfer opening 116 in association with the movement of the interference member 133*a*.

From the developing cartridge 110 dismounted from the image forming apparatus body 10, the developer cartridge 121 may be removed in the direction R3 opposite to the mounting direction R1. At this time, the first, the second, and the fourth shutter members 131, 132 and 134, being free from the mounting force between the developer cartridge 121 and the developing cartridge 110, are released from the contacts with respect to the locking projection 131*b*, the leading end 121*a* of the developer cartridge 121, and the locking protrusion 134*a*, respectively. Accordingly, the first, the second, and the fourth shutter members 131, 132 and 134 are restored into their respective initial positions by elastic bias from the first, the second and the fourth elastic members 135, 136 and 138.

A recovering force of the second elastic member 136 for restoring the second shutter member 132 is exerted in the direction R3 opposite to the mounting direction R1 of the developer cartridge 121, assisting in the dismounting the developer cartridge 121 from the developing cartridge 110.

Figure 6A:
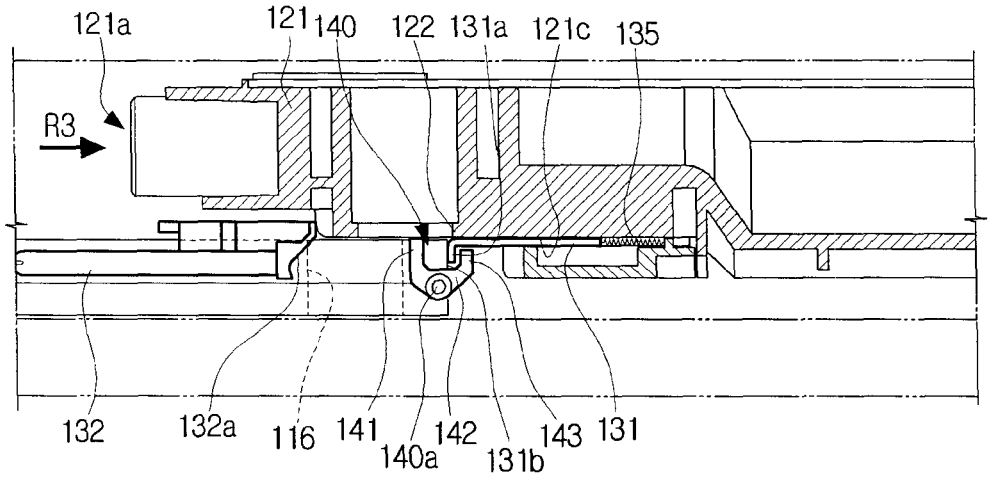
FIGS. 6A through 6C are views illustrating closing operations of the first and the second shutter members according to an embodiment of the invention.
Figure 6B:
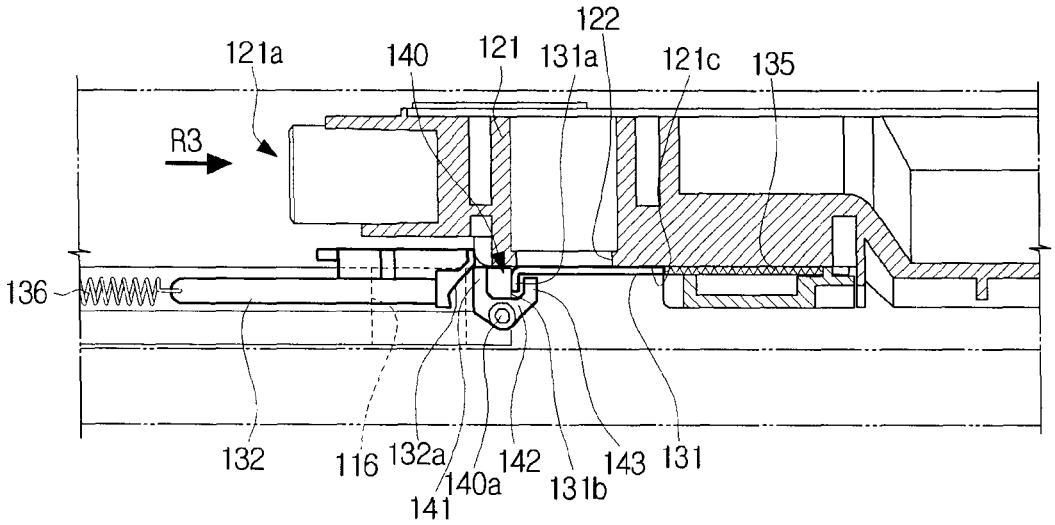
Figure 6C:
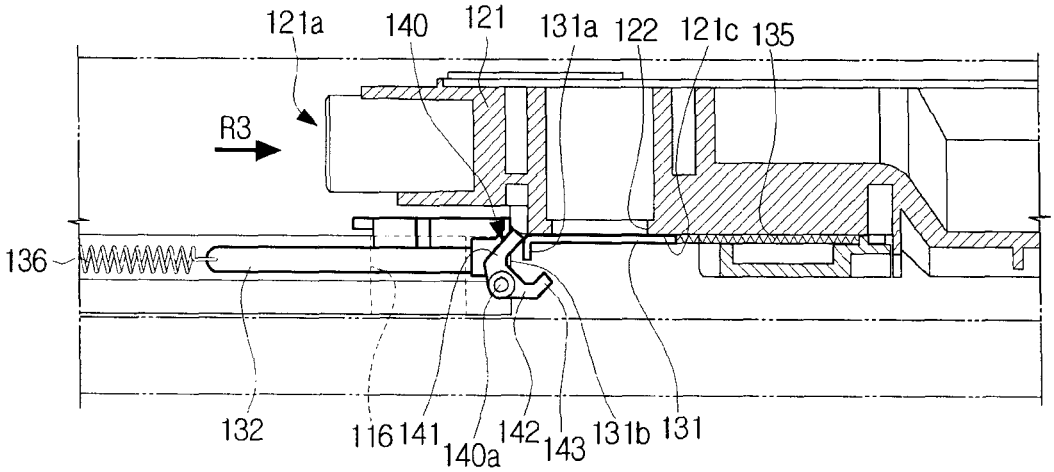

As the developer cartridge 121 is removed in the direction R3, as shown in FIGS. 6A through 6C, the pressure protrusion 143 of the guide lever 140 presses and supports the bent end of the first shutter member 131 in the first direction R1 until the first wing 141 is released from the contact with the bottom of the developing cartridge 121. Consequently, the pulling by the guide lever 140 of first shutter member 131 in the first direction R1, in addition to the recovering force of the first elastic member 135 toward the first direction R1, acts to completely close the first transfer opening 122.

The contact force between the pressure protrusion 143 and the first shutter member 131 is maintained until the first wing 141 becomes free from the contact force with respect to the bottom 121*c* of the developer cartridge 121, and is rotated by the inclined surface 132*a* of the second shutter member 132 in the opposite direction of the mounting direction R1 to release the bent end 131*a* of the first shutter member 131 from the pressure protrusion 143. As shown in FIG. 6C, as the developer cartridge 121 moves further in the direction R3, the inclined surface 132*a* of the second shutter member 132 interferes with, and further rotates, the first wing 141 in the direction R3, thereby restoring the guide lever 140 to the initial position.

According to the configuration described above, as the developing cartridge 110 is dismounted from the image forming apparatus body 10, the third transfer opening 117 of the developing cartridge 110 is first closed by the third shutter member 133. And when the developer cartridge 121 is dismounted from the developing cartridge 110, the fourth transfer opening 123 is closed by the fourth shutter member 134 and then the first and the second transfer openings 122 and 116 are closed by the first and the second shutter members 131 and 132. That is, as the developer cartridge 121 is dismounted, the developer collecting path T2 is closed first and then the developer supply path T1 is closed.

Figure 11:
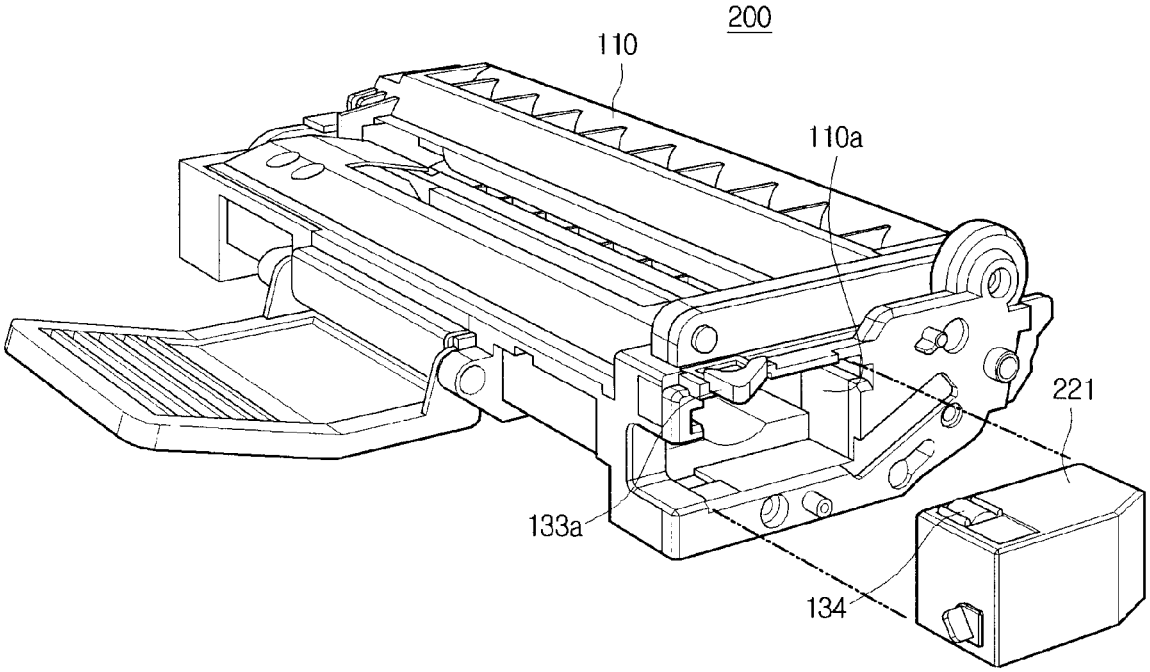
FIGS. 11 and 12 are perspective views schematically illustrating a developing device according to an embodiment of the present invention.
Figure 12:
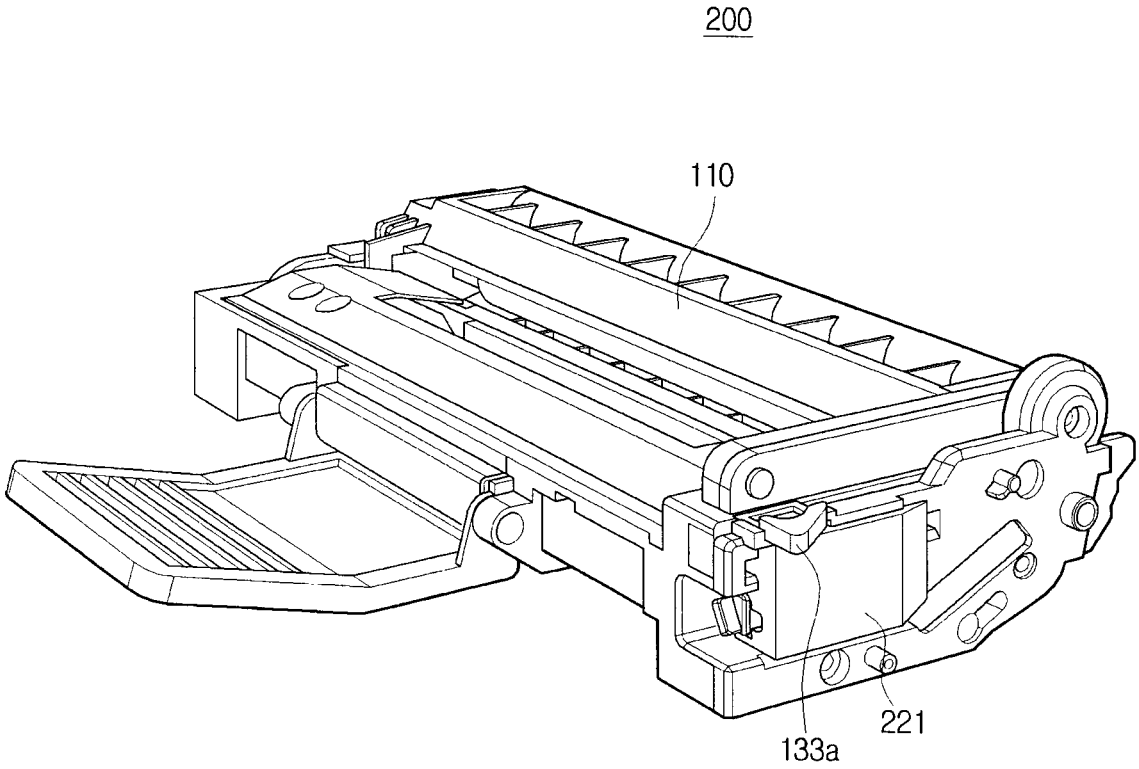

FIGS. 11 and 12 illustrate an image forming apparatus according to another embodiment of the present invention.

A developing device 200 of an image forming apparatus 1 according to this embodiment is similar to the developing device 100 of the image forming apparatus of previously described embodiment in that it includes a developing cartridge, a developer containing unit 120, and a shutter 130. The elements similar to those of the previously embodiment are assigned with the same reference numerals, and were previously described with reference to FIGS. 1 through 10.

The developing device 200 according to this embodiment includes a waste developer container 221, which does not contain developer for supplying to the developing cartridge 110, but has a structure for collecting waste developer discharged from the developing cartridge 110. Unlike the developer cartridge 121 of the previous embodiment, the waste developer container 221 includes only a collecting path T2 as the developer transfer path.

The developing device 200 may have a quantity of developer in the developing cartridge sufficient for printing a number of printing medium. Once the developer available in the developing cartridge 110 is used up, a developer cartridge 121 as illustrated in the previous embodiments, e.g., may be mounted in the mounting recess 110*a* of the developing cartridge 110, replacing the waste developer container 221.

If the waste developer container 221 including only the collecting path T2 is mounted in the developing cartridge 110, third and fourth transfer openings 117 and 123 are formed in the developing cartridge 110 and the waste developer container 221, respectively, to open and close the collecting path T2. Correspondingly, the shutter unit 130 includes third and fourth shutter members 133 and 134 disposed in the developing cartridge 110 and the waste developer container 221, respectively, to open and close the third and the fourth transfer openings 117 and 123.

As described in the forgoing embodiment, the third and the fourth shutter members 133 and 134 opens the third and the fourth transfer openings 117 and 123, respectively as the developing cartridge 110 is mounted in the image forming apparatus body 10 and the waste developer container 221 is mounted in the developing cartridge 10. Also, the third and the fourth shutter members 133 and 134 are elastically supported by third and fourth elastic members 137 and 138 in directions of closing the third and the fourth transfer openings 117 and 123.

The third and the fourth shutter members 133 and 134 are interfered by the image forming apparatus body 10 and by a locking protrusion 134*a* formed on the developing cartridge 110, respectively, and thus are made to move in the direction R1, thereby opening the third and the fourth transfer openings 117 and 123.

Operations of opening and closing the collecting path T2 of the developing device 200 of the image forming apparatus 1 according to the embodiment shown in FIGS. 11 and 12 are similar to the operations of opening and closing the collecting path T2 of the developing device 100 according to the embodiment described earlier, and thus detailed descriptions thereof will not be repeated.

According to the exemplary embodiments of the present invention, since only the developer containing unit 120 is dismounted from the developing cartridge 110 for the purpose of developer replenishment, the image forming apparatus can be used economically.

Also, since the transfer path for the developer is selectively opened and closed in association with operations of mounting and dismounting the developer cartridge 121 containing the developer and/or the waste developer container 221 in and from the developing cartridge 110, a developer leak may be reduced during the replacement. Therefore, contaminations due to developer leak may be prevented.

Although a few embodiments of the present invention have been shown and described, it will be appreciated by those skilled in the art that changes may be made in these embodiments without departing from the principles and spirit of the general inventive concept, the scope of which is defined in the appended claims and their equivalents.

What is claimed is:

1. A developing device of an image forming apparatus, comprising:

a developing cartridge which has a mounting recess therein;

a developer containing unit which contains developer therein, and which is replaceably disposed in the mounting recess of the developing cartridge to form a developer transfer path fluidly communicating with the developing cartridge; and a shutter unit which opens the developer transfer path when the developer containing unit is mounted in the developing cartridge, and which closes the developer transfer path when the developer containing unit is removed from the developing cartridge, the shutter unit being elastically biased in a direction which closes the developer transfer path, wherein the developer containing unit comprises a developer cartridge which contains both a quantity of developer to be supplied to the developing cartridge and waste developer discharged from the developing cartridge, and wherein the developer transfer path comprises a supply path, through which the quantity of developer is transferred from the developer cartridge to the developing cartridge, and a collecting path, through which the waste developer is transferred from the developing cartridge to the developer cartridge.

2. The developing device as claimed in claim 1, wherein the supply path comprises first and second transfer holes which are formed in the developer cartridge and the developing cartridge, respectively, such that they fluidly communicate with each other when the developer cartridge is mounted in the developing cartridge.

3. The developing device as claimed in claim 2, wherein the collecting path comprises third and fourth transfer holes which are formed in the developing cartridge and the developer cartridge, respectively, such that they fluidly communicate with each other when the developer cartridge is mounted in the developing cartridge.

4. The developing device as claimed in claim 3, wherein the shutter unit comprises first and second shutter members which are disposed in the developer cartridge and the developing cartridge, respectively, to open and close the first and the second transfer holes.

5. The developing device as claimed in claim 4, wherein the shutter unit comprises third and fourth shutter members which are disposed in the developing cartridge and the developer cartridge, respectively, to open and close the third and the fourth transfer holes.

6. The developing device as claimed in claim 5, wherein the third shutter member opens the third transfer hole after at least one of the first shutter member, the second shutter member and the fourth shutter member opens at least corresponding respective one of the first transfer hole, the second transfer hole and the fourth transfer hole.

7. The developing device as claimed in claim 5, wherein, after at least one of the first and the second shutter member opens corresponding respective one of the first and the second transfer hole, the fourth shutter member opens the fourth transfer hole, after which the third shutter member opens the third transfer hole.

8. The developing device as claimed in claim 5, wherein the first shutter member, the second shutter member, and the fourth shutter member open the first transfer hole, the second transfer hole, and the fourth transfer hole, respectively, when the developer cartridge is mounted in a first direction into a mounting recess formed in the developing cartridge.

9. The developing device as claimed in claim 8, wherein the third shutter member opens the third transfer hole if the developing cartridge is mounted in the image forming apparatus body in a second direction perpendicular to the first direction.

10. The developing device as claimed in claim 9, wherein the first through the fourth shutter members are elastically biased by first through fourth elastic members in directions of closing the first through the fourth transfer holes.

11. The developing device as claimed in claim 10, wherein the third shutter member opens the third transfer hole as an interference member protruding from the third shutter member is interfered by the image forming apparatus body to thereby move in the first direction, wherein the fourth shutter member opens the fourth transfer hole as the fourth shutter member is moved in a direction opposite to the first direction by a locking protrusion formed on the developing cartridge.

12. The developing device as claimed in claim 1, wherein the developing cartridge is provided with a waste developer transferring means for transferring the waste developer, which has been cleaned off an organic photoconductive medium, to the developer cartridge through the collecting path.

13. A developing device of an image forming apparatus, comprising:

a developing cartridge which has a mounting recess therein;

a developer containing unit which is replaceably disposed in the mounting recess of the developing cartridge to form a developer transfer path fluidly communicating with the developing cartridge; and a shutter unit, which is elastically biased in a direction of closing the developer transfer path, and which opens the developer transfer path as the developer containing unit is mounted in the developing cartridge, wherein the developer transfer path further comprises a collecting path through which waste developer is collected from the developing cartridge to the developer containing unit.

14. The developing device as claimed in claim 13, wherein the developer transfer path comprises a supply path through which developer is supplied from the developer containing unit to the developing cartridge, wherein the shutter unit opens the supply path due to a mounting force of the developer containing unit, and, if the shutter unit is free from the mounting force of the developer containing unit, the shutter unit closes the supply path due to the elastic bias.

15. The developing device as claimed in claim 14, where the elastic bias on the shutter unit reinforces a mounting/dismounting force of the developer containing unit with respect to the developing cartridge.

16. The developing device as claimed in claim 15, wherein the supply path comprises first and second transfer holes which are formed in the developer containing unit and the developing cartridge, respectively, such that the first and second transfer holes fluidly communicate with each other when the developer containing unit is mounted in the developing cartridge, wherein the shutter unit comprises first and second shutter members which are disposed in the developer containing unit and the developing cartridge, respectively, to open and close the first and the second transfer holes.

17. The developing device as claimed in claim 16, wherein the first shutter member is prevented from moving further in a direction of mounting of the developer containing unit by a locking projection formed in proximity of the second transfer hole of the developing cartridge, thereby opening the first transfer hole, wherein the second shutter member is interfered by a leading end of the developer containing unit to moved in the direction of mounting the developer containing unit as the developer containing unit is mounted, thereby opening the second transfer hole.

18. The developing device as claimed in claim 17, further comprising a guide lever which is disposed on the locking projection, the guide lever being rotated by interference from the developer containing unit to assist in opening and closing the supply path.

19. The developing device as claimed in claim 18, wherein the first shutter member has one end, which is brought into contact with the locking projection, and which is bent toward the developing cartridge, wherein the guide lever comprises:

a first wing, which is rotated in the first direction by the one end of the first shutter member, and which has a length such that the first wing is brought into contact with a bottom of the developer containing unit;

a second wing, which has a length shorter than that of the first wing, and which is spaced from the first wing by a predetermined angle; and a pressure protrusion, which protrudes from the second wing, and which presses the one end of the first shutter member in the first direction as the first wing is brought into contact with the bottom of the developer containing unit.

20. The developing device as claimed in claim 19, wherein the second shutter member has an inclined surface corresponding to the first wing at an initial position to restore the first wing to the initial position.

21. The developing device as claimed in claim 13, wherein the collecting path comprises third and fourth transfer holes which are formed in the developing cartridge and the developer containing unit, respectively, such that the third and fourth transfer holes fluidly communicate with each other when the developer containing unit is mounted in the developing cartridge.

22. The developing device as claimed in claim 21, wherein the shutter unit comprises third and fourth shutter members which are disposed in the developing cartridge and the developer containing unit, respectively, to open and close the third and the fourth transfer holes.

23. The developing device as claimed in claim 22, wherein the third shutter member opens the third transfer hole when the developing cartridge is mounted in an image forming apparatus body in a second direction perpendicular to a first direction in which the developer containing unit is mounted, wherein the fourth shutter member opens the fourth transfer hole when the developer containing unit is mounted in the developing cartridge.

24. An image forming apparatus, comprising: an image forming apparatus body where a transfer path for a printing medium is formed; and a developing device according to any one of claims 1, 2-12, 13-20 and 21-23 which develops a predetermined image on the printing medium.

25. An image forming apparatus, comprising:

a developer cartridge which has a supply path shutter to open and close a supply path for supplying a developer, and a first collecting path shutter to open and close a waste developer collecting path for collecting waste developer; and a developing cartridge, in which the developer cartridge is mounted, and which has a second collecting path shutter disposed in proximity of the first collecting path shutter to open and close the waste developer collecting path, wherein, after the developer supply path shutter and the first collecting path shutter open the supply path and the collecting path, the second collecting path shutter opens the collecting path.

26. The image forming apparatus as claimed in claim 25, wherein the first collecting path shutter opens the collecting path as the developer cartridge is mounted in the developing cartridge, wherein the second collecting path shutter opens the supply path as the developing cartridge is mounted in an image forming apparatus body.

27. An image forming apparatus, comprising:

a developer cartridge having a supply path shutter to open and close a supply path for supplying a developer and a first collecting path shutter to open and close a waste developer collecting path for collecting a waste developer; and a developing cartridge, in which the developer cartridge is mounted, and which has a second collecting path shutter disposed in proximity of the first collecting path shutter to open and close the waste developer collecting path, wherein, after the second collecting path shutter closes the collecting path, the supply path shutter and the first collecting path shutter close the supply path and the collecting path.

28. A developer cartridge, comprising:

a developer cartridge body which is replaceably mounted in a developing cartridge, the developer cartridge body having a developer transfer path fluidly communicating with the developing cartridge, the developer transfer path including:

a supply path through which developer is transferred from the developer cartridge body to the developing cartridge, and a collecting path through which waste developer is transferred from the developing cartridge to the developer cartridge body; and a shutter unit which opens and closes the developer transfer path as the developer cartridge body is mounted in the developing cartridge, with the shutter unit arranged on the supply path, a collecting path shutter unit for the opening and closing the collecting path is arranged in the developer cartridge body in addition to the supply path shutter unit, and the collecting path shutter unit is opened after the supply unit shutter is opened.

29. The developer cartridge as claimed in claim 28, wherein the supply path comprises a first transfer hole which is formed in the developer cartridge such that the first transfer hole fluidly communicates with a second transfer hole formed in the developing cartridge when the developer cartridge is mounted in the developing cartridge.

30. The developer cartridge as claimed in claim 29, wherein the supply path comprises a fourth transfer hole which is formed in the developer cartridge such that the fourth transfer hole fluidly communicates with a third transfer hole formed in the developing cartridge when the developer cartridge is mounted in the developing cartridge.

31. The developer cartridge as claimed in claim 30, wherein the shutter unit comprises first and fourth shutter members to selectively open and close the first and the fourth transfer holes, wherein the first and the fourth shutter members are elastically biased by first and fourth elastic members in a direction of closing the first and the fourth transfer holes.

32. The developer cartridge as claimed in claim 28, wherein the supply path shutter unit opens the supply path during a process of mounting the developer cartridge body in the developing cartridge.

33. The developer cartridge as claimed in claim 32, wherein the developing cartridge is mounted in an image forming apparatus, and the collecting path shutter unit opens the collecting path during a process of mounting the developing cartridge in the image forming apparatus.

34. A developing device detachably supported in an image forming apparatus, comprising:

a developing device body having formed thereon a mounting recess defining a mounting space into which to receive a developer containing unit configured to accommodate developer therein;

a developer transfer path provided between the mounting space and an inner volume defined by the developing device body; and a first transfer opening formed in the mounting recess, the shutter unit comprising a first Shutter member disposed on the developing device body to close the first transfer opening;

a shutter unit configured to open the developer transfer path when the developer containing unit is mounted in the mounting recess so as to allow transfer of developer at least in one direction between the developer containing unit and the inner volume, and to close the developer transfer path when the developer containing unit is removed from the mounting recess; and a locking member rotatably mounted on the developing device body, the locking member being configured to rotate between an initial position and a locking position, the locking member not interfering with a movement of the developer containing unit within the mounting recess when in the initial position, the locking member being in interlocking contact with at least a portion of the developer containing unit when the locking member is in the locking position.

35. The developing device of claim 34, wherein the locking member is configured to rotate to the initial position by coming into interfering contact with a portion of the first shutter member.

36. The developing device of claim 35, wherein the locking member is configured to contact the portion of the first shutter member when the first shutter member in a closed position closing the first transfer opening, the portion of the first shutter member having a shape corresponding to a portion of the locking member in the initial position.

37. The developing device of claim 35, wherein the locking member comprises:

a first extension and a second extension spaced apart from each other, the first extension being longer than the second extension, the first extension being configured to be in an interfering contact with the portion of the first shutter member so as to cause the locking member to rotate to be in the initial position, the shape of the portion of the first shutter member corresponding the first extension when the locking member is rotated to the initial position.

38. The developing device of claim 34, wherein the developer transfer path further comprises:

a second transfer opening formed in the mounting recess, the shutter unit comprising a second shutter member disposed to close the second transfer opening.

39. The developing device of claim 38, wherein:

the first shutter member includes a first protruding portion that extends into the mounting recess to interfere with at least a portion of the developer containing unit to thereby cause the first shutter member to open when the developer containing init is received into the mounting recess, and wherein the second shutter member includes a second protruding portion that extends outward from the developing device body to interfere with at least a portion of the image forming apparatus to thereby cause the second shutter member to open when the developing device body is received into the image forming apparatus.

40. The developing device of claim 39, wherein each of the first shutter member and the second shutter member is elastically biased be in a closed position, in which to close, respectively, the first transfer opening and the second transfer opening.

41. A developing device detachably supported in an image forming apparatus, comprising:

a developing device body having formed thereon a mounting recess defining a mounting space into which to receive a developer containing unit configured to accommodate developer therein, the developer containing unit includes:

a cover member received in the mounting recess of the developing device body, the cover member including a waste developer collection chamber, a second transfer opening through which to receive waste developer from the inner volume into the waste developer collection chamber, and a second shutter member disposed on the cover member to close the second transfer opening, the second transfer opening being in alignment with the first transfer opening when the cover member is received in the mounting recess; and a developer transfer path provided between the mounting space and an inner volume defined by the developing device body, the developer transfer path including:

a first transfer opening formed in the mounting recess, the shutter unit comprising a first shutter member disposed on the developing device body to close the first transfer opening; and a shutter unit configured to open the developer transfer path when the developer containing unit is mounted in the mounting recess so as to allow transfer of developer at least in one direction between the developer containing unit and the inner volume, and to close the developer transfer path when the developer containing unit is removed from the mounting recess.

42. The developing device of claim 41, wherein:

the first shutter member includes a first protruding portion that extends outward from the developing device body to interfere with at least a portion of the image forming apparatus to thereby cause the first shutter member to open the first transfer opening when the cover member is received into the image forming apparatus, and wherein the second shutter member includes a second protruding portion that interferes with at least a portion of the developing device body so as to open the second transfer opening when the cover member is received into the mounting recess.

43. The developing device of claim 42, further comprising:

a developing roller housed in the developing device body, the developing roller being configured to apply developer on an electrostatic latent image to form a developer image, wherein the developing roller extends lengthwise along a first rotational axis about which the developing roller rotates, the mounting recess extending inwardly into the developing device body parallel to the first rotational axis.

44. The developing device of claim 43, further comprising:

a photoconductive medium having a surface on which to support the electrostatic latent image, the photoconductive medium being configured to rotate about a second rotational axis parallel to the first rotational axis.

45. The developing device of claim 44, further comprising:

a cleaning unit disposed adjacent the photoconductive medium to remove waste developer from the surface of the photoconductive medium; and a waste developer conveying member disposed in the developing device body for conveying the waste developer towards the first transfer opening.

* * * * *